US005343945A

United States Patent [19]

Weingarten et al.

[11] Patent Number: 5,343,945

[45] Date of Patent: Sep. 6, 1994

[54] DOWNHOLDE GAS/OIL SEPARATION SYSTEMS FOR WELLS

[75] Inventors: Jean S. Weingarten; M. Jane Williamson, both of Anchorage; Jeffrey L. Harris, Eagle River, all of Ak.

[73] Assignee: Atlantic Richfield Company, Los Angeles, Calif.

[21] Appl. No.: 20,524

[22] Filed: Feb. 19, 1993

[51] Int. Cl.[5] ..... E21B 43/12

[52] U.S. Cl. ..... 166/105.5; 166/117.5; 166/188

[58] Field of Search ..... 166/105.5, 117.5, 188, 166/265, 372, 373

[56] References Cited

U.S. PATENT DOCUMENTS

| | | | |
|---|---|---|---|
| 1,886,886 | 11/1932 | Kelley et al. | 166/265 |
| 2,190,104 | 2/1940 | McCoy | 166/105.5 |
| 2,244,684 | 6/1941 | Foran | 166/265 |
| 2,293,196 | 8/1942 | Crump | 166/265 |
| 2,883,940 | 4/1959 | Gibson | 166/105.5 |
| 4,509,599 | 4/1985 | Chenoweth et al. | 166/372 |
| 4,531,584 | 6/1985 | Ward | 166/265 |
| 4,589,482 | 5/1986 | Bayh, III | 166/117.5 X |
| 4,738,313 | 4/1988 | McKee | 166/372 |
| 5,048,610 | 9/1991 | Rose et al. | 166/117.5 X |
| 5,240,073 | 8/1993 | Bustamante et al. | 166/265 |

*Primary Examiner*—Thuy M. Bui
*Assistant Examiner*—Frank S. Tsay
*Attorney, Agent, or Firm*—Michael E. Martin

[57] ABSTRACT

Oil and gas are separated downhole in a free flowing well and are transmitted separately to the surface. Liquid oil is transmitted through an elongated tubing which extends into a liquid column in the bottom of the well and is anchored in a liquid production tubing string to form an annular flow space. Gas flows from a wellbore space above the column of liquid through the annular space and through a flow passage which may be formed by a side pocket mandrel into the well annulus and then to the surface. The liquid conducting tubing is secured in the tubing string and a seal point is formed by a packer above the gas flow passage formed by the side pocket mandrel. Alternative arrangements provide for a subsurface gas flow safety valve interposed in the gas flow path. The safety valve may be interposed in a cross-over body which permits flow of liquid and gas therethrough and past a seal formed between the body and the tubing string.

15 Claims, 2 Drawing Sheets

DOWNHOLDE GAS/OIL SEPARATION SYSTEMS FOR WELLS

BACKGROUND OF THE INVENTION

1. Field of the Invention

The present invention pertains to systems for separating produced gas from crude oil or similar hydrocarbon liquids in a wellbore and whereby the produced gas and oil may be conveyed separately to the surface for further treatment, distribution or reinjection of the gas into nearby wells, for example.

2. Background

In certain wells which produce hydrocarbon liquids, the amount of formation gas entering the well or gas entrained in the liquid entering the well may be significant. Reservoirs which are subjected to pressurized gas injection to stimulate oil flow may produce gas commingled with the oil or gas may migrate to the production wells and flow into the wells at perforations spaced from the perforations which are producing primarily hydrocarbon liquids. If the gas and oil are required to be produced to the surface through the same conduit, elaborate facilities must be provided at the surface for separation of the gas from the oil. The facilities may require substantial reduction of the gas pressure during treatment thereof, thereby requiring costly recompression of the gas for transport or reinjection into a nearby formation.

In certain oil fields such as those of the Alaskan North Slope, the gas/oil ratio from certain wells is particularly high due to natural formation conditions and also due to the use of gas injected into the formation at high pressures to stimulate additional oil flow to producing wells. Accordingly, it has been deemed desirable to reduce the cost of gas/oil separation at the surface resulting from the production of high volumes of gas commingled with the produced oil. Moreover, wells which originally were configured for primarily oil production have not been capable of producing separate streams of downhole separated oil and gas prior to the present invention. Several advantages may be realized from substantial separation of gas from oil in the wellbore and production of the gas and oil through separate conduits to the surface. Surface separation and treatment facilities may be minimal or even eliminated at or near the production well site. If the gas entering the well is at relatively high pressure, the potential energy of this gas may be preserved by producing it to the surface through a separate conduit, thereby reducing the recompression power requirements and, in some instances, the gas may be used for artificial lift or stimulation purposes for nearby wells without requiring any recompression. The present invention has been developed with these desiderata in mind.

SUMMARY OF THE INVENTION

The present invention provides unique systems for separation of gas from oil produced into a wellbore from a subterranean formation and conveyance of the separated gas and oil through separate flow paths to the surface.

In accordance with one important aspect of the present invention, a system is provided for separating gas from oil in the wellbore of a free flowing production well wherein oil is conveyed through a production flow conduit to the surface and gas flowing into the wellbore and separated from oil in the wellbore is conducted to the surface through a separate flow path including the wellbore annulus. The well includes an installation of a packer and a liquid conveying tubing section within the liquid production tubing string and wherein the tubing section extends down to a liquid column in the bottom of the wellbore. The tubing string preferably includes at least one conduit section which is characterized as a modified gas lift mandrel which communicates gas separated from oil or similar hydrocarbon liquids in a wellbore space below the packer through the mandrel into the wellbore annulus and then to the surface. The gas lift mandrel may include a so-called subsurface safety valve interposed therein for shutting off gas flow to the surface if the gas pressure or flow velocity exceeds a predetermined amount.

In accordance with another aspect of the present invention, one alternate embodiment of the system includes a subsurface safety valve which is interposed in a well structure which includes spaced apart packers installed in the production tubing string in such a way that gas separated from the oil flowing to the surface is conducted through the subsurface safety valve and then through a gas lift mandrel ported to permit gas to flow to the wellbore annulus.

A further alternate embodiment of a downhole gas-oil separation system includes another modified arrangement of a subsurface safety valve for controlling the flow of gas and interposed in a unique cross-over body disposed in a production tubing string.

The downhole gas separation system provides several advantages, including those mentioned hereinabove, for wells which are producing measurable amounts of gas with oil or similar hydrocarbon liquids. Wells which were originally configured for primarily oil production at low gas/oil ratios or which normally would be shut in due to production at high gas/oil ratios can be converted for production of gas for use in repressurization of a reservoir or for use as lift gas in other wells. Downhole gas from oil separation minimizes the requirement of surface treatment or separation facilities and the highly pressurized gas may be used without further compression or at reduced compression costs. Certain formations may improve oil production due to the improved venting of gas from the wellbore resulting in reduced liquid pressure in the wellbore sufficient to produce more oil from formation zones of interest. These advantages as well as other important aspects and features of the present invention will be further appreciated by those skilled in the art upon reading the detailed description which follows in conjunction with the drawing.

DESCRIPTION OF THE PREFERRED EMBODIMENTS

Figure 1:
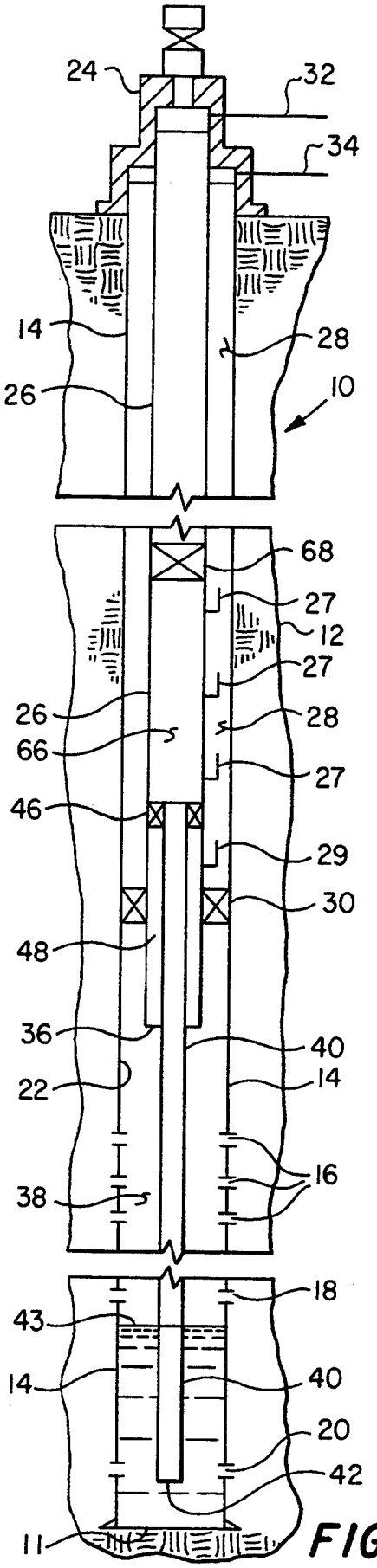
FIG. 1 is a vertical central section view in schematic form of a gas and oil production well including one embodiment of a separation system in accordance with the present invention.

In the description which follows, like parts are marked throughout the specification and drawing with the same reference numerals, respectively. The drawing figures are not intended to be to scale and certain features are shown in generalized or schematic form in the interest of clarity and conciseness.

Referring to FIG. 1, there is illustrated a schematic view of a primarily crude oil production well 10 which has been drilled into an earth formation 12. The well 10 includes a conventional casing 14 which is perforated at multiple spaced apart sets of perforations 16, 18 and 20. The perforations 16 may, for example, open into a zone of interest from which substantial amounts of gas and some oil are produced into the wellbore 22 while the perforations 18 and/or 20 penetrate a zone of interest of the formation 12 from which gas and oil or primarily oil is produced into the wellbore.

The casing 14 extends to a conventional wellhead 24 from which a production tubing string 26 depends into the well. An annular space 28 is formed between the casing 14 and the tubing string 26 and extending between a conventional packer 30 and the wellhead 24. The tubing string 26 may have one or more conventional gas lift mandrel sections 27 interposed therein including a lowermost gas lift mandrel section 29. A liquid or crude oil production flowline 32 is in communication with the tubing string 26 at the wellhead 24 and a gas production flowline 34 is in communication with the annulus 28 at the wellhead.

The tubing string 26 terminates at a lower distal end 36 which, in some instances in accordance with the present invention, is located several hundred feet above the bottom 11 of the well 10. Accordingly, a substantial wellbore space 38 is provided between the packer 30 and the bottom 11 of the well into which gas and oil may flow. This space 38 may provide for substantial separation of gas from oil, and both fluids may be withdrawn from the well under the urging of wellbore pressures by the provision of an improved arrangement which includes an oil-conveying conduit or tubing 40, smaller in diameter than the bore of tubing string 26. The tubing 40 extends from within the lower portion of the tubing string 26 downwardly through the space 38 and terminates at a distal end 42 above the wellbore bottom 11 but immersed in a column of liquid 43 in the wellbore space 38. The tubing 40 may be several hundred feet long and is preferably suspended from within the interior of the tubing string 26 using hanger or anchor apparatus to be described in further detail herein.

The tubing hanger apparatus may also include or be connected to a suitable wellbore packer 46 which delimits an annular space 48 formed between the tubing string 26 and the tubing 40 and between the packer 46 and the tubing string distal end 36. As is indicated in FIG. 1, the packer 46 forms a seal within the tubing string 26 above the gas lift mandrel section 29 so that this section may be in communication with the space 48 and the wellbore space 38 to receive pressure gas therefrom and communicate same to the annulus 28. In other words, the tubing string 26 is provided with suitable means, which may comprise a gas lift mandrel section 29, spaced above the packer 30 but below the packer 46 forming a flow passage for communication of gas from the tubing space 48 to the annulus 28.

The arrangement illustrated in FIG. 1 provides for substantial downhole separation of gas from oil in a well which is flowing both gas and oil under pressure conditions which exist in the formation zones of interest which are in communication with the perforations 16, 18 and 20. With the arrangement according to FIG. 1, gas and oil may flow, already separated, to the surface through the respective flow paths provided by the annulus 28 and the tubing string 26 so that the surface facilities are minimal for treatment and separation of gas from oil. The gas separated in the wellbore 22 may be conducted via flowline 34 to a compressor, not shown, or if gas pressure at the flowline 34 is sufficient, the gas may be conducted to a nearby well, not shown, for reinjection into a reservoir or for use in artificial lift operations.

Figure 2:
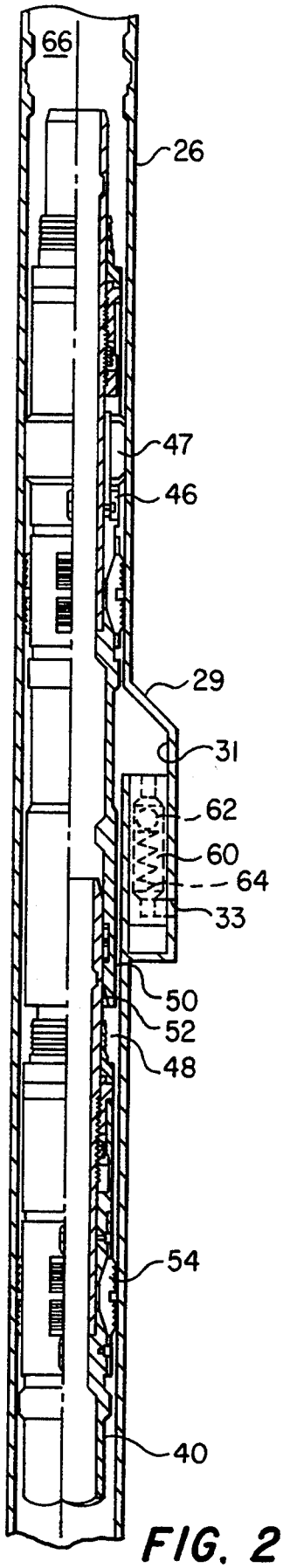
FIG. 2 is a longitudinal central section view of some of the major components of one embodiment of the system of the present invention.

Referring briefly to FIG. 2, one embodiment of a system in accordance with the present invention is shown in further detail. In FIG. 2 the packer 46 is illustrated including its annular seal member 47. The packer 46 is connected to an overshot seal assembly 50 which depends from the packer and is suitably connected to an upwardly projecting conduit portion 52 of a tubing anchor 54. In FIG. 2 the tubing 40 is illustrated depending from the anchor 54 and the annular space 48 is formed between the tubing 40 and the mechanical components which interconnect the tubing with the packer 46.

In FIG. 2 a retrievable safety valve assembly 60 is shown in somewhat schematic form disposed in the side pocket 31 of the mandrel 29. The valve 60 may be of a type which includes a closure member 62 which is spring biased to remain off of a seat 64 to allow gas to flow from space 48 through ports 33, one shown, into the annulus 28. However, in response to a predetermined differential pressure acting across the closure member 62 due to gas flow from the space 48 through the side pocket mandrel 29, the closure member will shut off further gas flow, thus operating in the manner of a conventional subsurface safety valve.

Alternatively, the mandrel pocket 31 may be provided with a suitable sleeve, not shown in FIG. 2, in place of the valve assembly 60 which will still permit flow of gas from the space 48 to the exterior of the mandrel 29, through ports 33 and into the annulus 28. Such an arrangement is preferred for the embodiments illustrated in FIGS. 3 and 4 and to be described hereinbelow. Accordingly, a well which has a substantial amount of gas flow or a so-called high gas-to-oil ratio may be adapted to have the system of the present invention installed therein by providing the tubing string 26 to have at least one flow path in communication with the annulus 28 which may be provided by a conventional gas lift mandrel section such as the section 29. The liquid conducting tubing 40 may be installed in the tubing 26 using commercially available components illustrated in FIG. 2 including the anchor 54, the overshot seal assembly 50 and the packer 46. This structure may be put in place using conventional wireline or similar setting equipment or the anchor 54 and the packer 46 may be also set hydraulically. Type SS-RO Packer and Anchor Assemblies, available from Texas Ironworks, Inc., Houston, Tex., together with a type TIW Overshot Seal Assembly, also available from the same vendor, may used for the components 46, 50 and 54.

Accordingly, oil may be conducted up through the tubing string 40 and the interior of the anchor 54, the overshot seal assembly 50 and the packer 46 to the interior 66 of the tubing string 26 above the packer for conduction to the surface. As shown in FIG. 1, a conventional subsurface safety valve 68 may be interposed in the tubing string 26 preferably above the uppermost gas lift mandrel section 27, as indicated. The gas lift mandrels may not be required in the tubing string 26 as long as suitable gas flow porting is provided in the tubing string between the interior space 48 and the annulus 28 and between the packer 30 and the packer 46. The mandrels 27, typically, have conventional gas lift valves or so-called dummy valves (plugs) installed therein.

However, in some wells it may be desirable to install one or more conventional side pocket gas lift mandrels in the tubing string 26 and of a type commercially available from several sources including Teledyne Merla and Otis Engineering Corporation of Houston and Dallas, Tex., respectively. Installation of these gas lift mandrels in the tubing string 26 will eventually permit artificial gas lift operations to be conducted on the well 10 itself even though with the arrangement described herein, the well may be operated for some substantial period of time in the mode described hereinabove.

Although downhole separation of oil from gas using the systems described herein is described and shown in conjunction with a substantially vertical well, the systems may work even more effectively in somewhat deviated wells where there is a tendency for the gas to flow along the upper side of the wellbore while liquid tends to flow downwardly along the lower side of the deviated wellbore. In this way, unwanted entrainment of liquid droplets in the upwardly flowing gas stream is avoided somewhat more easily than with generally vertical wells.

Figure 3:
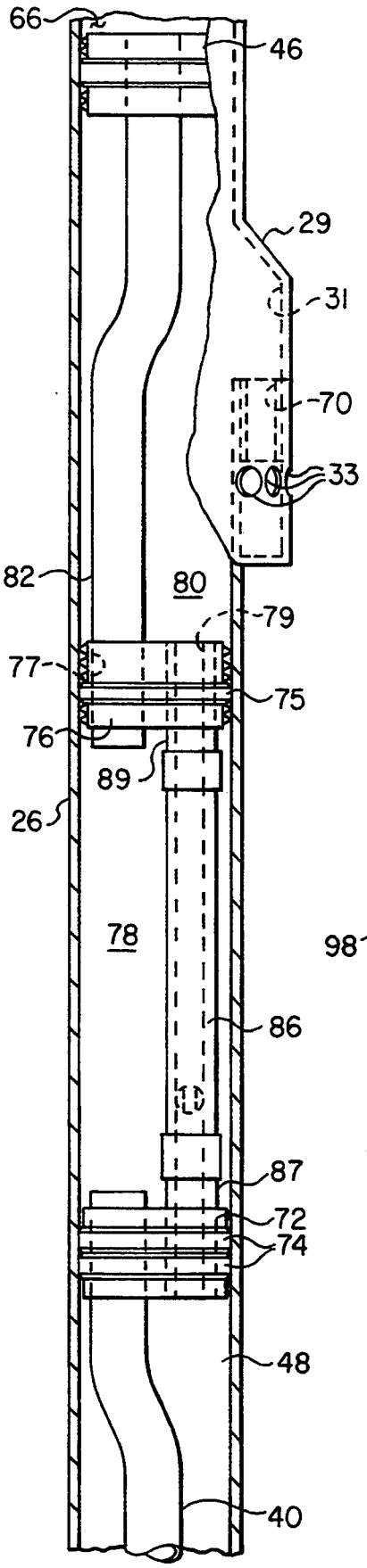
FIG. 3 is a longitudinal central section view of an alternate embodiment of a system in accordance with the present invention.

Referring now to FIG. 3, an alternate embodiment of a system for conducting separated gas and oil to the surface is illustrated. In the arrangement of FIG. 3, the tubing string 26 and gas lift mandrel 29 are utilized and the side pocket 31 is left empty and in communication with the ports 33 or, as shown, a suitable tubular sleeve type insert 70 may be installed in the side pocket to minimize wear of the mandrel structure. In the arrangement of FIG. 3, the oil conducting tube 40 is shown connected to a seal body 72 which has suitable seal means 74 provided thereon to form a fluid tight seal with the inner wall of the tubing string 26. In the arrangement of FIG. 3 the space 48 is delimited by the seal body 72.

An assembly which includes the seal body 72 also includes a conventional dual packer 76 interposed between the seal body and the packer 46. The packer 76 includes two separate flow passages 77 and 79 for oil and gas, respectively, and forms a fluid tight seal 75 between the packer and the tubing string 26. The packer 76 also defines a liquid flow space 78 within the tubing string 26 between the seal body 72 and the packer. A second flow space 80 is defined between the packers 76 and 46 and an oil conducting tube 82 extends between the packers 76 and 46. Accordingly, oil may flow from the tubing 40 to space 66 by way of the space 78 and the tubing 82 through suitable flow passages provided in the seal body 72 as well as the passage 77 in the packer 76 and suitable passages in the packer 46, respectively. Gas flows from the space 48 to the space 80 and through the ports 33 into the well annulus by way of a subsurface safety valve 86 which is interposed in the space 78 between the seal body 72 and the packer 76 and is connected to the body 72 and the packer 76 by conduit means 87 and 89, respectively. The seal body 72 may also be a conventional dual packer such as are commercially available from Baker Packers, Houston, Tex. The subsurface safety valve 86 may be of a type commercially available such as a pressure differential safety valve sold under the trademark Storm Choke J by Otis Engineering Corporation, Dallas, Tex. Accordingly, if the gas flow velocity increases beyond a predetermined rate as set by the pressure differential setting of the safety valve 86, this valve will close to stop the flow of gas between the space 48 and the space 80.

Figure 5:
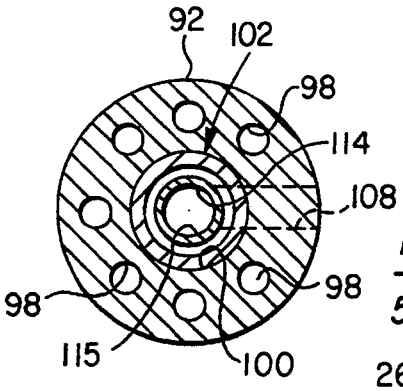
FIG. 5 is a section view taken along the line 5—5 of FIG. 4.
Figure 4:
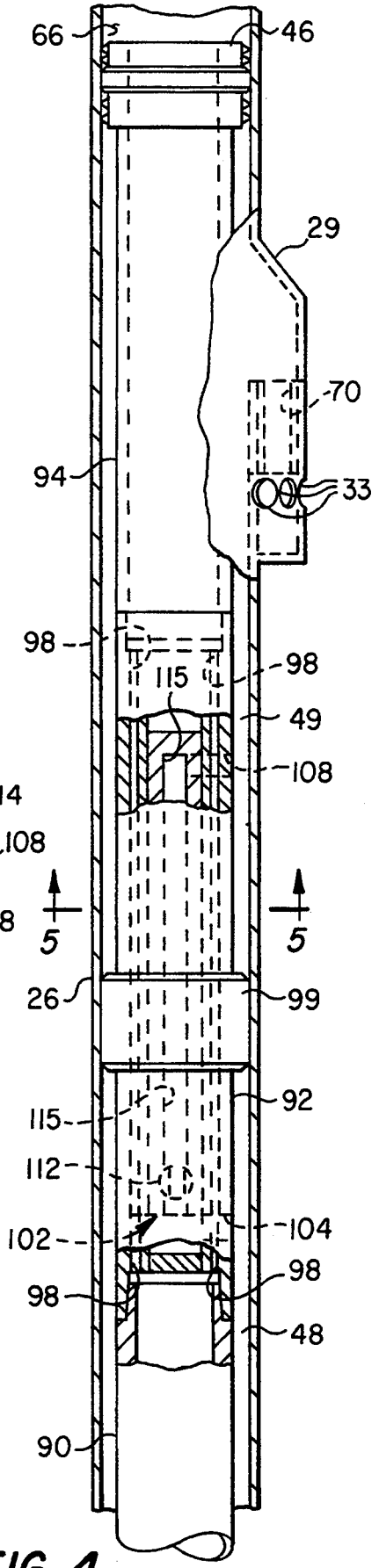
FIG. 4 is a longitudinal central section view of another alternate embodiment of a system in accordance with the present invention.

Referring now to FIGS. 4 and 5, another alternate embodiment of a system for conducting separated oil and gas from the well 10 is illustrated. In the arrangement of FIGS. 4 and 5, an elongated oil conducting tubing 90 is shown replacing the tubing 40 and connected to a cross-over body 92. The tube 90 extends downward into the column of liquid 43 in the wellbore space 38 in the same manner as the tube 40. The cross-over body 92 is, in turn, connected to a tubing section or sub 94 which is also connected to the packer 46. As shown in FIGS. 4 and 5, the cross-over body 92 includes plural oil conducting passages 98 arranged in a circumferential pattern around a central bore 100 which houses a subsurface safety valve, generally designated by the numeral 102. The passages 98 extend through the body 92 to permit flow of oil from the tubing 90 to the sub 94. The body 92 further includes circumferential seal or packing means 99 which is in sealing engagement with the inner wall of the tubing string 26.

Accordingly, gas may flow through the space 48 to the exterior of the lower end of the body 92 and through a suitable gas inlet port 104 formed in the body 92 and which is in flow communication with the subsurface safety valve 102. The subsurface safety valve 102 is also in flow communication with a gas exit port 108 formed in the body 92 and opening into an annular space 49 formed between the packing 99 and the packer 46. Accordingly, the flow path of gas is through the space 48 and into the cross-over body 92 through the port 104, then through the subsurface safety valve 102 and out of the cross-over body 92 by way of the exit port 108. Gas then flows through the annular space 49 and exits the side pocket mandrel 29 through the ports 33 into the annulus 28.

The subsurface safety valve 102 may also be of a type substantially like the aforementioned Storm Choke J type valve available from Otis Engineering Corporation. As indicated in FIGS. 3 and 4, a closure member 112, FIG. 4, is provided in the valve 102 between ports 104 and 108 and is movable in response to movement of a sliding sleeve type piston 114, FIG. 5, to close off fluid flow through a path formed by bore 115 extending between the ports to effect shut-off of gas flow between the spaces 48 and 49.

The arrangements illustrated in conjunction with FIGS. 3, 4 and 5 may be preferred when the gas flow rates are such that the flow area provided by the side pocket disposed safety valve 60 is insufficient to accommodate the desired flow rates and to minimize the pressure drop across such a valve. Alternatively, the well structure may be modified to provide a subsurface safety valve for controlling gas flow at a point in the annulus 28 between the gas lift mandrel 29 and the wellhead 24.

Installation of the various embodiments of the present invention may be carried out using conventional procedures familiar to those skilled in the art of wellbore structures and devices. The components described herein may be fabricated using conventional materials and techniques used for fabricating known types of wellbore components such as packers, hangers, anchors and subsurface safety valves. Although preferred embodiments of the invention have been described in detail, those skilled in the art will recognize that various substitutions and modifications may be made to the gas/oil separation systems of the present invention without departing from the scope and spirit of the appended claims.

What is claimed is:

1. In a well operable to produce both gas and oil into a wellbore space from at least one zone of interest of an earth formation wherein said well includes a casing extending in and defining at least part of a wellbore, a tubing string extending within said casing and defining a wellbore annulus extending to a wellhead, a seal between said tubing string and said casing delimiting said annulus and means forming a gas flow passage between the interior of said tubing string and said annulus, the improvement characterized by:

a tubing extending into said wellbore beyond the distal end of said tubing string, said tubing extending into a column of liquid in said wellbore space beyond said distal end of said tubing string and means delimiting a space within said tubing string in communication with said wellbore space and with said annulus by way of said gas flow passage for conducting gas between said wellbore space and said annulus whereby liquid separated from gas in said wellbore space may flow through the interior of said tubing and said tubing string to the surface and gas may flow from said wellbore space through said space between said tubing and said tubing string, said gas flow passage and said annulus to the surface.

2. The improvement set forth in claim 1 wherein:

said gas flow passage is provided by a side pocket mandrel section interposed in said tubing string.

3. The improvement set forth in claim 2 including:

valve means interposed in said side pocket mandrel and operable to close to prevent flow of gas into said annulus.

4. The improvement set forth in claim 1 wherein:

said means delimiting said space comprises a wellbore packer interposed in said tubing string and operably connected to said tubing.

5. The improvement set forth in claim 1 including:

means forming a first seal between said tubing and said tubing string and connected to said tubing;

means forming a second seal in said tubing string between said first seal and said gas flow passage;

means forming a third seal and comprising said means delimiting said space; and a gas flow control valve interposed between said means forming said first seal and said means forming said second seal for conducting gas to said gas flow passage and operable to close to prevent flow of gas.

6. The improvement set forth in claim 5 wherein:

said means forming said first seal comprises a body having seal means thereon for engaging said tubing string, said body being connected to said tubing and to conduit means connected to said valve.

7. The improvement set forth in claim 5 wherein:

said means forming said second seal comprises a dual wellbore packer having at least two separate fluid flow passages therein.

8. The improvement set forth in claim 5 wherein:

said means forming said third seal comprises a wellbore packer.

9. The improvement set forth in claim 5 including:

a conduit extending between said means forming said second seal and said means forming said third seal for conducting liquid through a portion of said tubing string which is in communication with said flow passage.

10. The improvement set forth in claim 1 including:

a body interposed in said tubing between said means forming said gas flow passage and the distal end of said tubing string, said body including means forming a fluid tight seal in said tubing string between the distal end of said tubing string and said means forming said gas flow passage, said body including liquid flow passage means extending therethrough for communicating liquid between said tubing and said tubing string, means forming a gas flow path in said body for conducting gas from said space to said gas flow passage so that gas may flow from said wellbore space to said annulus and a valve interposed in said body for effecting shut-off of gas flow from said wellbore space to said annulus.

11. In a well operable to produce both gas and oil into a wellbore space from at least one zone of interest of an earth formation wherein said well includes a tubing string extending therewithin, and means forming a gas flow passage in communication with the interior of said tubing string, the improvement characterized by:

a tubing extending into said wellbore beyond the distal end of said tubing string, said tubing extending into a column of liquid in said wellbore space beyond said distal end of said tubing string and means delimiting a space within said tubing string in communication with said wellbore space and with said gas flow passage for conducting gas between said wellbore space and said gas flow passage whereby liquid separated from gas in said wellbore space may flow through the interior of said tubing and said tubing string to the surface and gas may flow from said wellbore space through said space between said tubing and said tubing string and said gas flow passage to the surface;

a first seal between said tubing and said tubing string and connected to said tubing;

a second seal in said tubing string between said first seal and said gas flow passage;

a third seal comprising said means delimiting said space; and a gas flow control valve interposed between said first seal and said second seal for conducting gas to said gas flow passage and operable to close to prevent flow of gas.

12. The improvement set forth in claim 11 wherein:

said first seal comprises a body having seal means thereon for engaging said tubing string, said body being connected to said tubing and to conduit means connected to said valve.

13. The improvement set forth in claim 11 wherein:

said second seal comprises a dual wellbore packer having at least two separate fluid flow passages therein.

14. The improvement set forth in claim 11 wherein:

said third seal comprises a wellbore packer.

15. In a well operable to produce both gas and oil into a wellbore space from at least one zone of interest of an earth formation wherein said well includes a tubing string extending therewithin and means forming a gas flow passage in communication with the interior of said tubing string, the improvement characterized by:

a tubing extending into said wellbore beyond the distal end of said tubing string, said tubing extending into a column of liquid in said wellbore space beyond said distal end of said tubing string and means delimiting a space within said tubing string in communication with said wellbore space and with said gas flow passage for conducting gas between said wellbore space and said gas flow passage whereby liquid separated from gas in said wellbore space may flow through the interior of said tubing and said tubing string to the surface and gas may flow from said wellbore space through said space between said tubing and said tubing string and said gas flow passage to the surface; and a body interposed in said tubing between said gas flow passage and the distal end of said tubing string, said body including means forming a fluid tight seal in said tubing string between the distal end of said tubing string and said gas flow passage, said body including liquid flow passage means extending therethrough for communicating liquid between said tubing and said tubing string, means forming a gas flow path in said body for conducting gas from said space to said gas flow passage and a valve interposed in said body for effecting shut-off of gas flow from said wellbore space.

* * * * *